United States Patent [19]

Schuetz

[11] 4,128,040

[45] Dec. 5, 1978

[54] BLANK FIRING ADAPTER

[76] Inventor: Robert C. Schuetz, 2125 Quiemuth St., Olympia, Wash. 98503

[21] Appl. No.: 802,687

[22] Filed: Jun. 2, 1977

[51] Int. Cl.[2] ..... F41D 11/00

[52] U.S. Cl. ..... 89/14 E

[58] Field of Search ..... 89/14 E

[56] References Cited

FOREIGN PATENT DOCUMENTS 227570 5/1963 Austria ..... 89/14 E

*Primary Examiner*—Stephen C. Bentley

*Attorney, Agent, or Firm*—Nathan Edelberg

[57] ABSTRACT

A blank firing adapter for the M2 machine gun having a reciprocating barrel wherein the muzzle restrictor does not reciprocate, and wherein a base portion is positioned at the front of the gun feed tray to stop live cartridges in the feed belt from entering the gun whereas blank cartridges may be fed into the gun and fired.

8 Claims, 8 Drawing Figures

BLANK FIRING ADAPTER

GOVERNMENT RIGHTS

The invention described herein may be manufactured and/or used by or for the Government for governmental purposes without the payment of any royalty thereon.

BACKGROUND OF THE INVENTION

Training military troops in the use of firearms can be made safer and less costly by utilizing blank ammunition. It is also beneficial to train troops with the same weapons they will be using in the field. This familiarizes the troops with weapon functioning, cleansing, maintenance procedures, etc. Usually, however, the bullet traveling through the barrel plays a vital role in the functioning of most military weapons. For example, it causes a back pressure that is utilized in recycling the moving parts of the weapon. Since there is no bullet when using blank ammunition, a blank firing attachment (BFA) must be used to create the pressures necessary to make the weapon operate normally.

The BFA normally consists of a bore restricting device placed on the muzzle of the weapon. The BFA limits the escape of gases generated by the firing of blank rounds. The restricted flow simulates the effect of a bullet in the bore. The weapon will then cycle automatically in the same manner as when it is using live ammunition.

In a recoil operated weapon such as the M2 machine gun, there is no gas system to cycle it. Instead, the gun depends on reaction forces (or kick) of the cartridge detonation to energize the recoiling parts. The barrel recoil initiates movement of the cycling parts. Without a BFA of some sort, a blank cartridge, when fired, does not have enough reaction force to recoil the barrel and hence recycle the moving parts.

There is an ever present risk of feeding a live round into the weapon. This presents an extremely dangerous condition when using the previously described BFA's. A live round fired through these BFA's can send shrapnel in all directions. This becomes a potential danger to the operator and any other personnel in the area. This is especially true in the case of the larger caliber weapons such as the .50 cal. M2 machine gun.

SUMMARY OF THE PRESENT INVENTION

A BFA in accordance with the present invention overcomes the safety hazard previously discussed by eliminating the possibility of feeding a live round into the weapon. Advantage is taken of the fact that a blank cartridge is shorter than a live round since it does not have the bullet portion extending forwardly. This is accomplished in the present invention by the insertion of a U-shaped member in the feed tray of the weapon. The base of the U-shaped member occupies the space where the bullet of a live cartridge would normally enter the feed tray. Should the longer live round accidently be placed in the ammunition belt, the bullet portion will contact this U-shaped member as it is fed into the weapon and a stoppage will occur.

The legs of the U-shaped member extend to the muzzle end of the weapon and serve two purposes. First, they are utilized to clamp the BFA to the weapon by means of a bracket which engages the barrel support. The second function of the legs is to support the muzzle restrictor. The muzzle restrictor, tied to the receiver by the legs of the U-shaped member, provides the necessary back pressure for barrel rearward movement to initiate the recoil cycle of the machine gun.

DETAILED DESCRIPTION OF THE ILLUSTRATIVE EMBODIMENT

Figure 1:
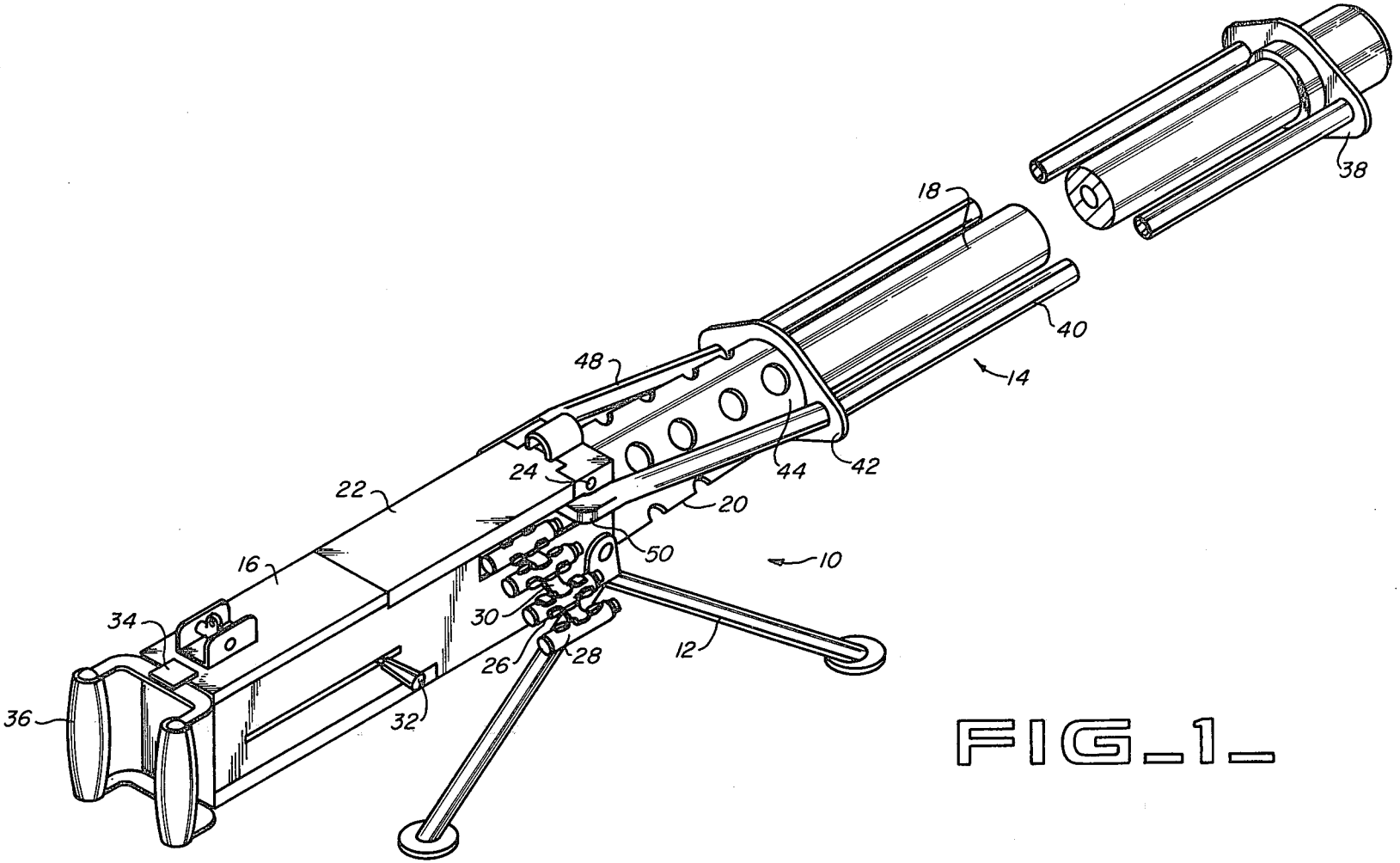
FIG. 1 is a perspective view of an M2 machine gun using the blank firing adapter of the present invention.

Reference is now made to FIG. 1, which shows in perspective an M2 machine gun 10 mounted on a tripod 12 and having the blank firing adapter 14 illustrating the present invention. As can be seen, this gun includes a receiver 16 and barrel 18. A barrel guide 20, extending forwardly of the receiver, has bearing surfaces, not shown, to support the barrel 18 as it cycles for and aft between its locked and unlocked positions, as will be explained hereinafter. A feed tray cover 22 is pivotally mounted on the receiver at pivot 24 to facilitate the loading of the ammunition belt 26, which comprises a plurality of cartridges 28 interconnected by means of disintegrating links 30. Receiver 16 carries a charging handle 32 which may be manually pulled rearwardly to cock the gun for initial firing. A firing mechanism 34 is positioned between two handles 36 which the operator retains in both hands so that the firing mechanism 34 may be activated with the operator's thumb. All of the foregoing is conventional, well known in the art, and is briefly mentioned herein to establish the structure with which the blank firing adapter of the present invention is used. The firing adapter 14 comprises a muzzle restrictor 38 which fits over the end of barrel 18, a pair of sleeves 40 between the muzzle restrictor and a mounting bracket 42. This mounting bracket 42 bears against the forward end 44 of the barrel guide 20. The barrel guide has a plurality of apertures 46 and is spaced radially from the barrel 18 to prevent the operator from engaging the heated portion of the barrel during operation. A U-shaped member 88 consisting of a pair of legs 48 and a base portion 50 retain the muzzle restrictor 38 in a fixed position while the barrel 18 is free to reciprocate in its usual manner. The legs 48 extend through sleeves 40 and through openings on the muzzle restrictor which is fastened thereto by means of lock nuts 52. The base portion 50 of the U-shaped member 88 fits across the forward portion of the feed tray and under the feed tray cover 22. This base portion 50 limits the longitudinal length of the cartridges 28 that may be fed into the gun. This takes advantage of the fact that blank cartridges are shorter in length than live rounds and accordingly permits the blank cartridges to be fed into the gun, but will prevent the feeding of live rounds, which are longer.

Figure 2:
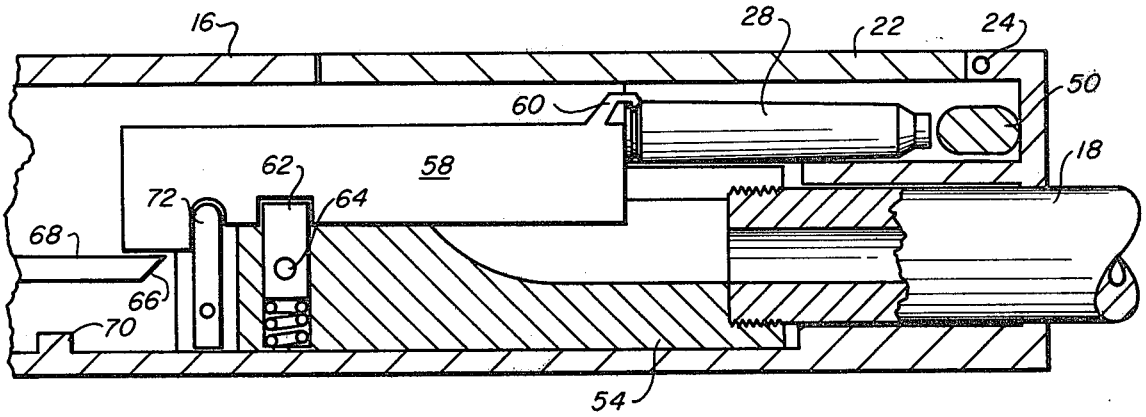
FIG. 2 is a sectional view illustrating the operation of the reciprocating parts.

Reference is now made to FIG. 2 which illustrates the operation of the reciprocating parts. Here there is shown the receiver 16 with the innermost or breech end of the barrel 18 connected to a barrel extension 54 which moves longitudinally within the receiver 16. A blank cartridge 28 is shown positioned within the feed tray 56 in front of the bolt 58 which is mounted for relative longitudinal movement relative to the barrel extension 54 and has an extraction claw 60 to withdraw the cartridge 28 from the feed tray when the bolt 58 moves rearwardly. A locking lug 62 interconnects the bolt and barrel extension as shown. This locking lug 62 has a transverse extending pin 64 on it which engages the cam surface 66 of a projection 68 on the receiver 16 when the barrel extension 54 moves sufficiently rearwardly. When this occurs, the locking lug 62 is depressed and frees the bolt 58 for further rearward movement. Receiver 16 has a projection 70 thereon which engages an accelerator 72 pivotally mounted on the barrel extension 54. This serves to limit the rearward motion of the barrel extension 54 and through the lever action of the accelerator 72, further projects the bolt 58 rearwardly to complete the recoil cycle. Springs not shown then drive the bolt 58 forwardly and this action chambers the cartridge 28 within the barrel 18 ready for firing. Upon the forward movement of the bolt 58, the barrel extension 54 and barrel 18 are also driven forwardly and the cartridge is fired to complete the cyclic operation of the gun and the parts are ready for the rearward thrust to repeat a new cycle. However, in the case of the firing of blank cartridges, the rearward thrust may be provided by the muzzle restrictor 38, which will be described in greater detail hereinafter.

Figure 3:
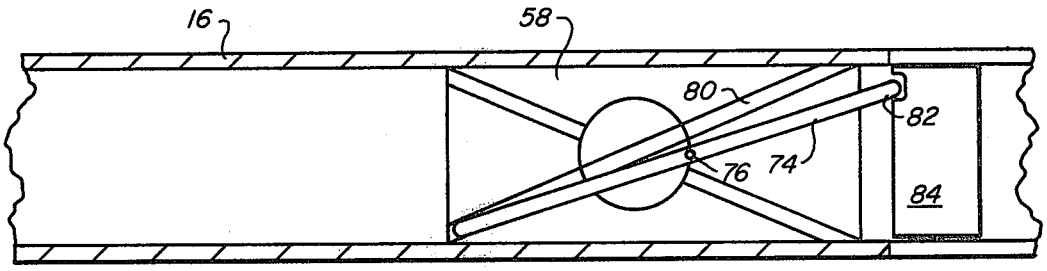
FIGS. 3 and 4 are plan views illustrating the two positions of the ammunition feed structure.
Figure 4:
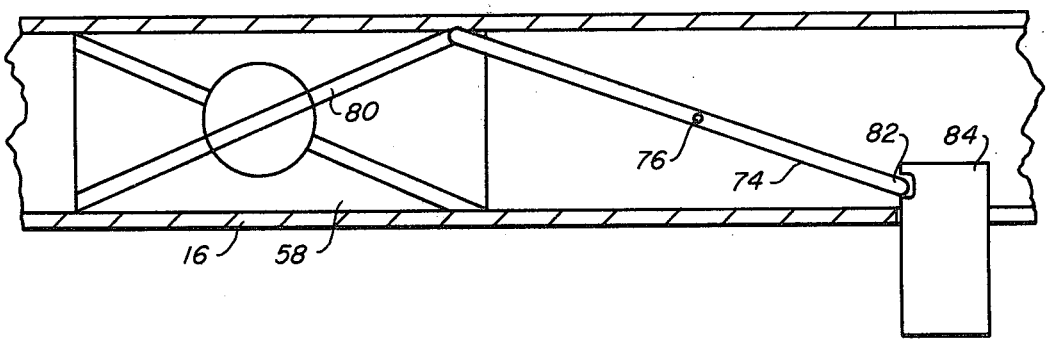

In FIG. 3 and FIG. 4 there is shown the two positions of the ammunition feed structure. In these views the structure is set for a right hand feed although it may be operated for a left hand feed also. Here is shown the receiver 16 with the bolt 58 positioned in FIG. 3 in its forwardmost position and in FIG. 4 in its rearwardmost position. Mounted on the receiver 16 is a pivotally mounted lever 74 mounted by pivot 76 to the feed tray. The rearward end 78 of lever 74 is adapted to ride in diagonal groove 80 of the bolt 58 so that the forwardmost end 82 of the lever reciprocates in a lateral direction, as can be seen in these views. An ammunition belt actuating structure or feed mechanism 84 engages the belt linkages and moves the belt in a right to left direction to supply cartridges to the gun as it is fired. This structure is also adapted to feed the ammunition belts from a left to right direction, but since this operation is basically similar in operation and is not part of the present invention, such operation will be omitted.

Figure 5:
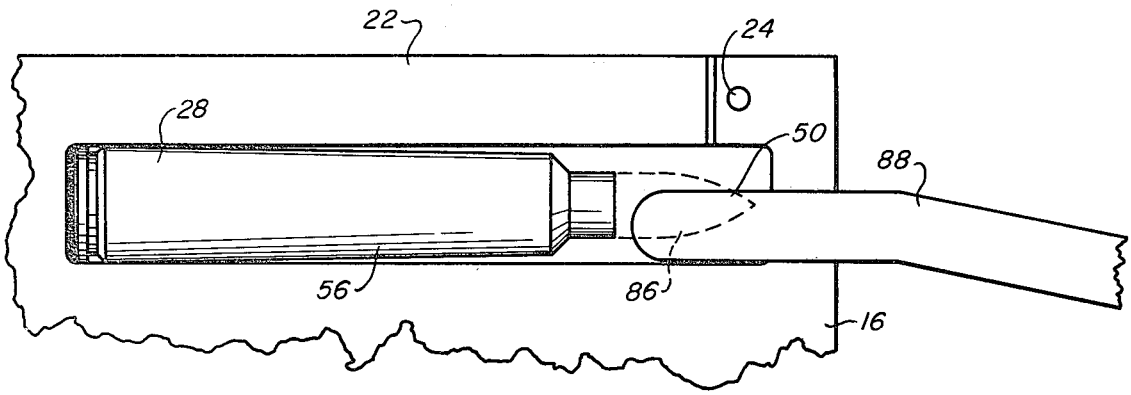
FIG. 5 is an enlarged portion illustrating how the adapter prevents a live round from being fed into the gun.

One of the principal features in the blank firing adapter of the present invention is that live rounds with the forward extending projectile 86 will not pass through the feed tray because of the base portion 50 of the U-shaped member 88. The U-shaped member 88 is shown in the enlarged view in FIG. 5. Here there is shown a portion of the receiver 16 having the feed tray cover 22 mounted thereon by means of pivot 24. A blank cartridge 28 is positioned within the feed tray 56. As can be seen, the blank cartridge 28 does not have the projectile 86, shown in dotted lines extending forwardly; therefore, there is ample clearance rearwardly of the base portion 50 of the U-shaped member 88. It can also be seen that the projectile 86, shown in dotted lines, which represents a live round, does not have sufficient clearance and cannot so pass. Therefore, a live round cannot feed while the BFA is installed on the weapon.

Figure 6:
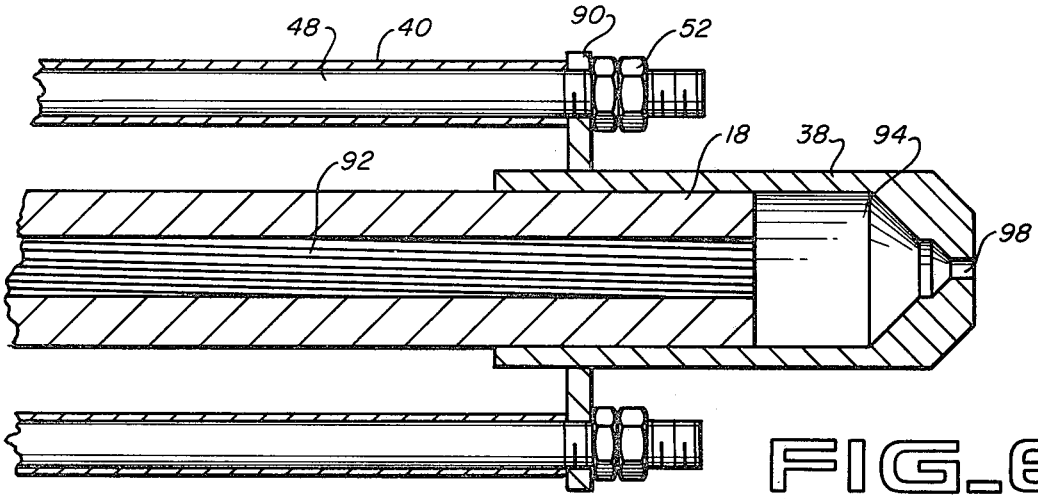
FIGS. 6 and 7 are sectional views showing the muzzle restrictor in fixed position while the barrel reciprocates between its locked or forward position and its unlocked or rearward position.
Figure 7:
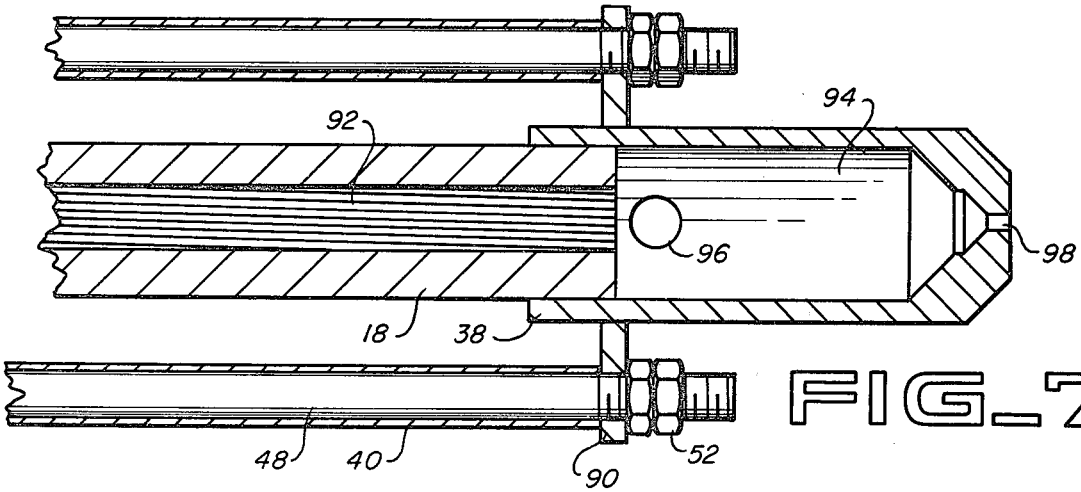

In FIG. 6 the barrel 18 is shown in its forward position where it is slidably engagable with the muzzle restrictor 38. Sleeves 40, which bear against the mounting bracket 42, as shown in FIG. 1, also bear against flange 90 on the muzzle restrictor 38 to maintain the restrictor in a proper spaced relationship to the end of the barrel 18. Sleeves 40 extend over the legs 48 and the flange 90 on the muzzle restrictor is secured to the legs 48 by means of lock nuts 52. When a blank cartridge is fired, it propels gases through the bore 92 of the barrel 18 and into the chamber 94 within the restrictor 38. As these gases continue to expand, they cause a rearward retraction of the barrel 18 to the position shown in FIG. 7. Restrictor 38 has escape orifices 96 in the sides thereof to depressurize the container 94 when the end of barrel 18 has moved sufficiently rearwardly to expose these orifices 96. The forward portion of chamber 94 of the muzzle restrictor 38 has a unique configuration which will protect the operators in the event a live round is deliberately inserted into the chamber and not fed thereto from the belt. Should a live round be fired, the projectile engages the reduced opening 98 in the front of the restrictor and causes some forward fragmentation of the restrictor. It should be noted, however, that the restrictor has tapered walls of increased thickness outwardly of this opening 98 which will resist further fragmentation which might prove to be a hazard. Opening 98 also serves the purpose of bleeding off excess pressure before the orifices 96 have been exposed to the chamber 94. It should be noted that the opening 98 is of a diameter smaller than that of the bore of the barrel. This is to assure adequate pressure build-up to operate the weapon.

Figure 8:
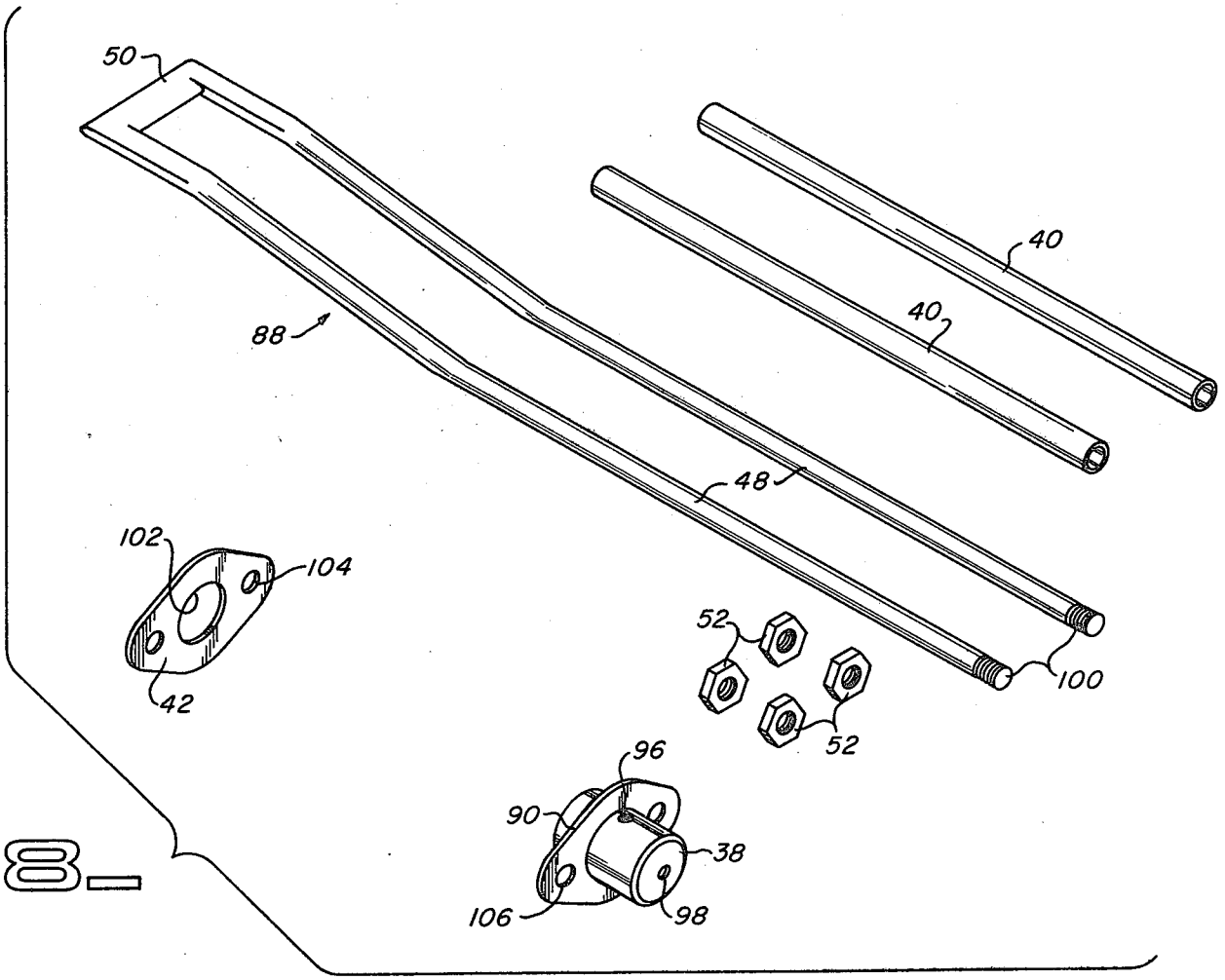
FIG. 8 is a perspective exploded view of the parts comprising the blank firing adapter.

An exploded view in perspective of the blank firing adapter hardware is shown in FIG. 8. Here can be seen the U-shaped member 88 consisting of the base portion 50 and legs 48 with the threaded ends 100 to accommodate the nuts 52. Sleeves 40 are of such diameter that they may be inserted over the legs 48. The mounting bracket 42 has an inner aperture 102 of sufficient size to fit over the barrel 18 and against the forward end of the barrel guide 20. This mounting bracket 42 has a pair of apertures 104 of sufficient size to fit over the legs 48. After the U-shaped member 88 is positioned with the base 50 within the feed tray and the mounting bracket 42 has been inserted over the barrel and the legs 48, the tubes 40 are next inserted over the legs 48. Thereafter, the muzzle restrictor 38 is positioned over the end of the barrel. The apertures 106 in flange 90 are passed over the ends of the legs 48 and secured against the ends of sleeves 40 by means of locking nuts 52.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A blank firing adapter for a gun having a longitudinally reciprocating barrel, said adapter comprising:

a muzzle restricter adapted to fit over the end of a gun barrel when said barrel is extended forwardly, a U-shaped member having a base portion adapted to pass across the feed tray of said gun where cartridges in an ammunition belt are fed into said gun, said base portion preventing passage of live cartridges into said gun while permitting passage of blank cartridges, said U-shaped member having legs extending forwardly to engage said muzzle restrictor, and means maintaining said muzzle restrictor in fixed position when said gun barrel reciprocates rearwardly.

2. A blank firing adapter as in claim 1 wherein said muzzle restrictor in conjunction with gases from a fired blank cartridge create pressures against said barrel to move it rearwardly.

3. A blank firing adapter as in claim 1 wherein said means maintaining said muzzle restrictor in fixed position comprises mounting bracket adapted to fit over said barrel and positioned against an immovable portion of said gun, said bracket having apertures to receive said legs, spacing sleeves inserted over said legs and bearing against said bracket, said muzzle restrictor bearing against said spacing sleeves and secured thereagainst by fastening means on said legs.

4. A blank firing attachment as in claim 3 wherein said muzzle restrictor has flanges with apertures therein insertable over said legs and bearing against said sleeves, said flanges being retained against said sleeves by nuts threaded onto said legs and bearing against said flanges.

5. A blank firing attachment as in claim 3 wherein said immovable portion of said gun is the forward end of the barrel guide on said gun.

6. A blank firing adapter as in claim 1 wherein said muzzle restrictor has an opening at the forward end thereof of a diameter less than that of the bore of said barrel.

7. A blank firing adapter as in claim 1 wherein said muzzle restrictor has an opening therein covered by said gun barrel when in its forward position and exposed when said gun barrel is in its rearward position.

8. A blank firing adapter as in claim 6 wherein said restrictor has thickened tapered walls outwardly of said opening.

* * * * *